US008122747B2

(12) United States Patent
McEldowney et al.

(10) Patent No.: US 8,122,747 B2
(45) Date of Patent: Feb. 28, 2012

(54) CAN END SCORING METHOD, AND TOOLING ASSEMBLY AND CONVERSION PRESS THEREFOR

(75) Inventors: Craig A. McEldowney, Russia, OH (US); Mark R. Mitchell, Sidney, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 869 days.

(21) Appl. No.: 12/132,279

(22) Filed: Jun. 3, 2008

(65) Prior Publication Data

US 2009/0293572 A1 Dec. 3, 2009

(51) Int. Cl.
*B21D 22/00* (2006.01)

(52) U.S. Cl. ..... 72/348; 72/332; 72/379.4; 413/17; 413/56; 413/67

(58) Field of Classification Search ..... 72/325, 72/326, 327, 332, 333, 335, 347, 348, 379.4, 72/715, 55; 413/8, 12, 15, 16, 17, 56, 58, 413/60, 67

See application file for complete search history.

(56) References Cited

U.S. PATENT DOCUMENTS

| | | | | | |
|---|---|---|---|---|---|
| 2,112,231 | A | * | 3/1938 | Speidel | 220/274 |
| 3,338,199 | A | | 8/1967 | Taylor | |
| 3,563,199 | A | | 2/1971 | Wolfe | |
| 3,650,006 | A | | 3/1972 | Kinkel | |
| 3,701,330 | A | | 10/1972 | Kinkel | |
| 3,728,980 | A | * | 4/1973 | Fraze | 72/325 |
| 3,898,944 | A | | 8/1975 | Holk, Jr. et al. | |
| 4,012,935 | A | * | 3/1977 | Holk et al. | 72/325 |
| 4,157,693 | A | * | 6/1979 | Openchowski et al. | 72/348 |
| 4,205,548 | A | * | 6/1980 | Bothner et al. | 72/404 |
| 4,254,890 | A | | 3/1981 | Westphal | |
| 4,348,464 | A | | 9/1982 | Khoury | |
| 4,627,265 | A | * | 12/1986 | Bulso et al. | 72/405.04 |
| 5,219,257 | A | * | 6/1993 | Koch | 413/67 |
| 5,373,721 | A | | 12/1994 | Welsh et al. | |
| 5,738,237 | A | | 4/1998 | McEldowney | |
| 5,860,553 | A | * | 1/1999 | Schubert | 220/271 |
| 5,974,851 | A | * | 11/1999 | Farwell | 72/325 |
| 6,260,728 | B1 | | 7/2001 | Turner et al. | |
| 6,315,511 | B1 | * | 11/2001 | Taube | 413/17 |
| 6,427,860 | B1 | | 8/2002 | Nishida et al. | |
| 6,575,684 | B2 | | 6/2003 | Heinicke et al. | |
| 7,552,535 | B2 | * | 6/2009 | Dicesare | 29/897 |

* cited by examiner

*Primary Examiner* — Edward Tolan
(74) *Attorney, Agent, or Firm* — Eckert Seamans et al.; Grant E. Coffield, Esq.

(57) ABSTRACT

A tooling assembly for scoring a can end is provided. First and second opposing tool members cooperate to create a depression in the can end, and to form a scoreline within the depression. A conversion press for converting a can end shell into a can end, and a method for scoring a can end are also provided. The method includes engaging a first side of the can end with a score knife, supporting at least a portion of a second side of the can end with a score anvil, depressing the can end into a cavity of the score anvil to form the depression, and forming the scoreline within the depression. The depression and scoreline are formed substantially simultaneous within the same tool station of the conversion press. A sealant, which is applied to the scoreline, forms a pool within the depression, thereby completely covering the scoreline.

8 Claims, 3 Drawing Sheets

CAN END SCORING METHOD, AND TOOLING ASSEMBLY AND CONVERSION PRESS THEREFOR

BACKGROUND OF THE INVENTION

1. Field of the Invention

The invention relates generally to can ends and, more particularly, to a can end scoring method. The invention also relates to tooling assemblies for scoring can ends. The invention further relates to conversion presses for providing scored can ends.

2. Background Information

Metallic containers (e.g., cans) for holding products such as, for example, food and beverages, are typically provided with an easy open can end on which a pull tab is attached (e.g., without limitation, riveted) to a tear strip or severable panel. The severable panel is defined by a scoreline in the exterior surface (e.g., public side) of the can end. The pull tab is structured to be lifted and/or pulled to sever the scoreline and deflect and/or remove the severable panel, thereby creating an opening for dispensing the contents of the can.

When the can end is made, it originates as a can end shell, which is formed from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, tab securing and tab staking, are performed until the shell is fully converted into the desired can end and is discharged from the press. Typically, each tool station of the conversion press includes an upper tool member, which is structured to be advanced towards a lower tool member upon actuation of a press ram. The shell is received between the upper and lower tool members. Thus, as the upper tool member engages the shell, the upper and/or lower tool members respectively act upon the public and/or product (e.g., interior side, which faces the can body) sides of the shell, in order to perform a number of the aforementioned conversion operations. Upon completion of a given operation, the press ram retracts the upper tool member and the partially converted shell is moved to the next successive tool station, or the tooling is changed within the same station, to perform the next conversion operation.

FIG. 1, for example, shows a portion of a can end 1 (e.g., partially converted shell) disposed between the upper and lower tool members 3,5 of a conventional conversion press tool station 7. The upper tool member 3 includes a score knife 9, which is disposed opposite and spaced apart from a score anvil 11 of the lower tool member 5. The score anvil 11 supports the product side 15 of the can end 1 as the score knife 9 is brought into contact with the public side 13 and creates the scoreline 17 therein, as shown. It will be appreciated that the public and product sides 13,15 of the can end 1 typically include a protective coating (not shown). Scoring the public side 13 of the can end 1 to create the scoreline 17 removes this protective coating at the location of the scoreline 17, thereby exposing the underlying metal of the can end 1.

As shown in FIG. 2, after the scoring operation, a post score repair procedure is typically performed in an attempt to cover (e.g., spray; coat; seal) the scoreline 17 with a suitable sealant 19 (e.g., without limitation, repair agent) to resist oxidation of the exposed metal. However, it is difficult to effectively and efficiently cover the edges 21,23 of the scoreline 17. Specifically, the edges 21,23 form relatively sharp intersections between the exposed metal of the scoreline 17 and adjacent portions of the public side 13 of the can end 1. It is difficult to ensure that the sealant 19, which is shown in simplified form in FIG. 2, sufficiently coats and adheres to the can end 1 at these locations (e.g., edges 21,23). Moreover, in an attempt to address this concern, an excessive quantity of the sealant 19' is sometimes applied to the can end 1, as shown in exaggerated form in phantom line drawing in FIG. 2.

There is, therefore, room for improvement in can end scoring methods, and in tooling assemblies and conversion presses for providing scored can ends.

SUMMARY OF THE INVENTION

These needs and others are met by embodiments of the invention, which are directed to a tooling assembly and an associated method for substantially simultaneously forming a depression (e.g., recessed area; channel; indentation) in a can end, and a scoreline within the depression. As a result of the scoreline being disposed in the depression, the scoreline can be effectively and efficiently completely coated by a suitable post score sealant or repair agent, which may be applied to the can end.

As one aspect of the invention, a tooling assembly is provided for scoring a can end. The can end comprises a scoreline defining a severable panel. The tooling assembly comprises: a first tool member; and a second tool member disposed opposite the first tool member, the second tool member being structured to cooperate with the first tool member in order to create a depression in the can end and to form the scoreline within the depression.

The first tool member may be a score knife, and the second tool member may be a score anvil. The can end may further comprise a first portion, a second portion and a third portion, and the score anvil may include a first support surface structured to support the first portion of the can end, a second support surface structured to support the second portion of the can end, and a cavity disposed between the first support surface and the second support surface beneath the third portion of the can end. The score knife may be structured to depress the third portion of the can end into the cavity of the score anvil in order to form the depression of the can end. The can end may further comprise a periphery, wherein the depression comprises a channel extending around the can end proximate the periphery, and wherein the scoreline is a peripheral scoreline extending around the can end within the channel. The can end may further comprise a first side and a second side disposed opposite the first side. The cavity of the score anvil may have a base, wherein the score knife is structured to engage the first side of the can end and to depress the can end into the cavity of the score anvil until the second side of the can end engages the base of the cavity. When the second side of the can end engages the base of the cavity, the score knife may be structured to score the first side of the can end, thereby forming the scoreline. The score knife may have a vertical axis, and the base of the cavity of the score anvil may have a center, wherein the vertical axis of the score knife is aligned with the center of the base of the cavity.

The scoreline of the can end may include an apex, a first edge and a second edge, wherein the apex of the scoreline is disposed between the first side of the can end and the second side of the can end, and wherein the first edge of the scoreline and the second edge of the scoreline are disposed at the first side of the can end. The first side of the first portion of the can end and the first side of the second portion of the can end may be disposed in a common plane, wherein the first edge of the scoreline and the second edge of the scoreline are disposed within the depression of the can end and below such common plane.

As another aspect of the invention, a conversion press is provided. The conversion press is structured to convert a can end shell into a can end. The can end comprises a scoreline defining a severable panel. The conversion press comprises: a press ram; at least one tool station; and a tooling assembly coupled to a corresponding one of the at least one tool station, the tooling assembly comprising: a first tool member, and a second tool member disposed opposite the first tool member. The press ram is structured to advance at least one of the first tool member and the second tool member toward the other of the first tool member and the second tool member. Responsive to the press ram advancing the at least one of the first tool member and the second tool member toward the other of the first tool member and the second tool member, the first tool member is structured to cooperate with the second tool member in order to create a depression in the can end and to form the scoreline within the depression.

The at least one tool station may be a first tool station and at least a second tool station. The first tool member and the second tool member may be coupled to the tooling assembly of the first tool station. The tooling assembly of the first tool station may be structured to substantially simultaneously form the depression in the can end and to form the scoreline within the depression.

As another aspect of the invention, a method of scoring a can end comprises: inserting a can end shell between opposing tool members of a tooling assembly within a tool station of a conversion press; advancing at least one of a first tool member and a second tool member toward the other of the first tool member and the second tool member, in order to at least partially convert the can end shell into a can end; forming a depression in the can end; and forming a scoreline within the depression of the can end.

The method may further comprise: engaging a first side of the can end with the score knife, supporting at least a portion of a second side of the can end with the score anvil, depressing the can end into a cavity of the score anvil in order to form the depression of the can end, and scoring the first side of the can end within the depression to form the scoreline of the can end. Forming the depression and forming the scoreline may be performed substantially simultaneous within the same tool station of the conversion press.

The method may further comprise: applying a sealant to the scoreline. The sealant may form a pool within the depression of the can end, thereby completely covering the scoreline disposed within the depression.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
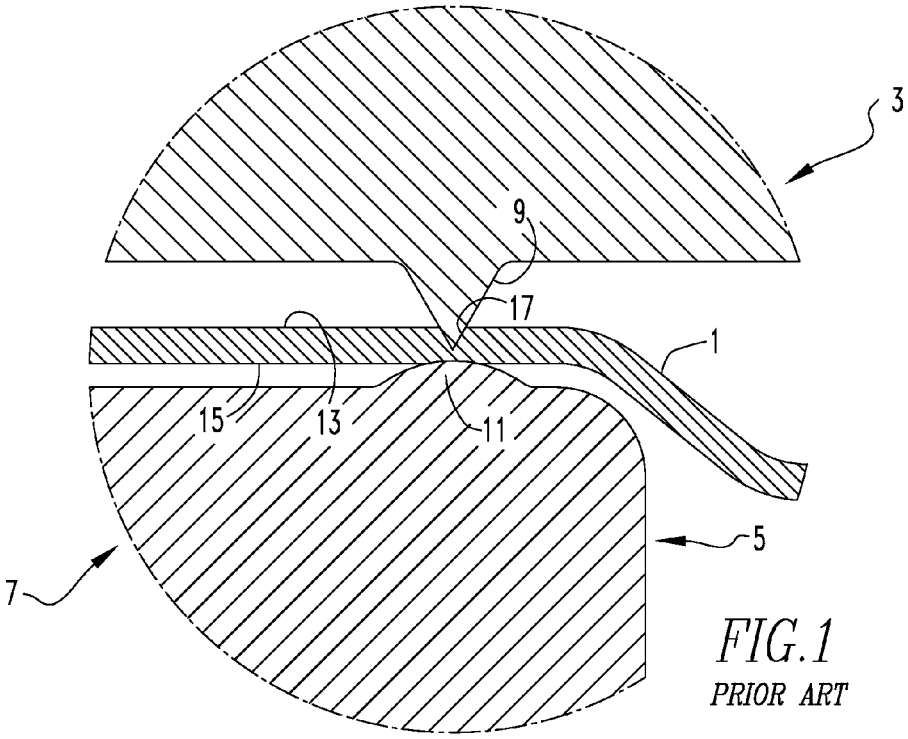
FIG.1 PRIOR ART
FIG. 1 is a sectional view of a portion of a tooling assembly for a conventional conversion press tool station, shown scoring a can end.

For purposes of illustration, embodiments of the invention will be shown and described as applied to the peripheral scoreline that defines the severable panel of a circular can end having a safety fold, although it will be appreciated that they could also be applied to provide any known or suitable scoreline other than the peripheral scoreline (e.g., without limitation, a mustache scoreline; a tear strip scoreline) for circular or non-circular can ends, with or without a suitable configuration of safety folds.

Directional phrases used herein such as, for example, upper, lower, above, below and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "can" refers to any known or suitable container, which is structured to contain a substance (e.g., without limitation, liquid; food; any other suitable substance), and expressly includes, but is not limited to, food cans, such as easy open food cans.

As employed herein, the term "can end" refers to the closure that is structured to be coupled to the can, in order to seal the can.

As employed herein, the term "can end shell" is used substantially interchangeably with the term "can end." The "can end shell" or simply the "shell" is the member that is acted upon and is converted by the disclosed tooling assembly and conversion press to provide the desired can end.

As employed herein, the term "sealant" refers to any known or suitable liquid, lacquer or other suitable coating (e.g., without limitation, repair agent), which is applied to the can end after it has been scored, in order to cover and protect (e.g., seal) the scoreline of the can end.

As employed herein, the term "depression" shall mean a recessed area (e.g., without limitation, channel; indentation) in the can end within which the scoreline is made, wherein the depression is structured to hold (e.g., pool; collect) sealant so that the sealant completely covers the scoreline.

As employed herein, the term "number" shall mean one or an integer greater than one (i.e., a plurality).

Figure 3:
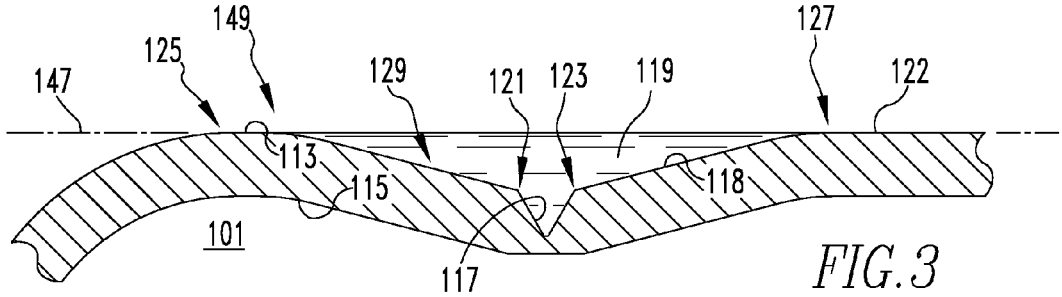
FIG. 3 is a sectional view of a portion of a can end formed in accordance with an embodiment of the invention.

FIG. 3 shows a portion of a can end 101, which has been formed in accordance with an embodiment of the invention. Specifically, the can end 101 includes opposing first (e.g., public) and second (e.g., product) sides 113,115. A scoreline 117 is formed within a depression 118 in the can end 101 on the public side 113 thereof. The depression 118 is structured to receive and collect (e.g., pool) a suitable sealant 119, in order to efficiently and effectively cover (e.g., coat; seal) the scoreline 117, as shown. It will be appreciated that, although the example scoreline 117 and corresponding depression 118 are disposed at or about the periphery 149 of the can end 101 so as to define the severable panel 122 of the can end 101, the disclosed tooling (e.g., tooling assembly 100 and conversion press 200 of FIG. 4) and associated method could be employed to form a wide variety of alternative scoreline/depression configurations (not shown), without departing from the scope of the invention.

Figure 2:
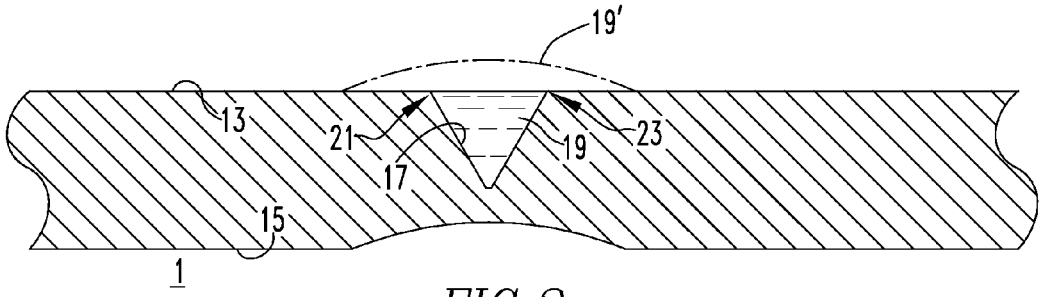
FIG.2 PRIOR ART
FIG. 2 is an enlarged view of the can end of FIG. 1, shown after a sealant has been applied to the scoreline thereof.

Continuing to refer to FIG. 3, the can end 101 includes a first portion 125, a second portion 127 and a third portion 129, which is disposed between the first and second portions 125, 127. The depression 118 and the scoreline 117, which is formed therein, are disposed in the third portion 129, as shown. More specifically, the first side 113 of the first portion 125 of the can end 101 and the first side 113 of the second portion 125 of the can end 101 are disposed in a common plane 147. The depression 118 comprises a bend or other suitable indentation in the third portion 129 of the can end 101, such that it is disposed below (e.g., from the perspective of FIG. 3) the common plane 147. This structure has the desirable effect of collecting the aforementioned sealant 119, which may be applied to the can end 101 after it has been scored, within the depression 118. Accordingly, the entire scoreline 117 is covered by the sealant 19, as shown in exaggerated form in FIG. 3. In this manner, among other benefits, complete and effective coverage of the scoreline 117 by the sealant 119 can be assured, without having to disadvantageously apply excessive sealant (see, for example, the excessive volume of sealant 19' in FIG. 2).

Accordingly, among other benefits, the disclosed depression 118 collects sealant 119 such that it covers not only the first and second edges 121,123 of the scoreline 117, but also a corresponding portion of the public side 113 of the can end 101 adjacent each of the scoreline edges 121,123. In addition, the resultant pool of sealant 119 is substantially flush with respect to the common plane 147 of the first and second portions 125,127 of the can end 101, as shown. In other words, the undesirable protruding and unsightly volume of sealant (see, for example, the convex shape of the excessive volume of sealant 19' in FIG. 2) commonly associated with known scoreline and post score repair methods, is substantially avoided. It will be appreciated that the depression 118 and volume of sealant 119 in FIG. 3 are shown in exaggerated form for simplicity of illustration. In practice, the depression 118 may be much smaller than the exaggerated representation in FIG. 3, while still achieving the desired objective of covering (e.g., sealing) the scoreline 117. Thus, it should be noted that a reduced quantity of sealant 119 is required to cover the scoreline 117, in accordance with the invention.

The scoreline 117 in the example of FIG. 3 includes a relatively sharp apex 120, which is disposed between the first and second sides 113,115 of the can end 101, and the aforementioned first and second edges 121,123, which are disposed at or about the public side 113 of the can end 101. Thus, the example scoreline 117 is generally V-shaped. However, it will be appreciated that the scoreline (e.g., 117) could have any known or suitable alternative shape and/or configuration (not shown), without departing from the scope of the invention. It will also be appreciated that the scoreline (e.g., 117) can be employed with or without a suitable number and/or configuration of safety folds (not shown), which are structured to form a protective peripheral edge on the severable panel 122 of the can end 101. Such safety folds are described, for example, in commonly assigned U.S. Pat. No. 7,270,246, which is hereby incorporated herein by reference.

Figure 4:
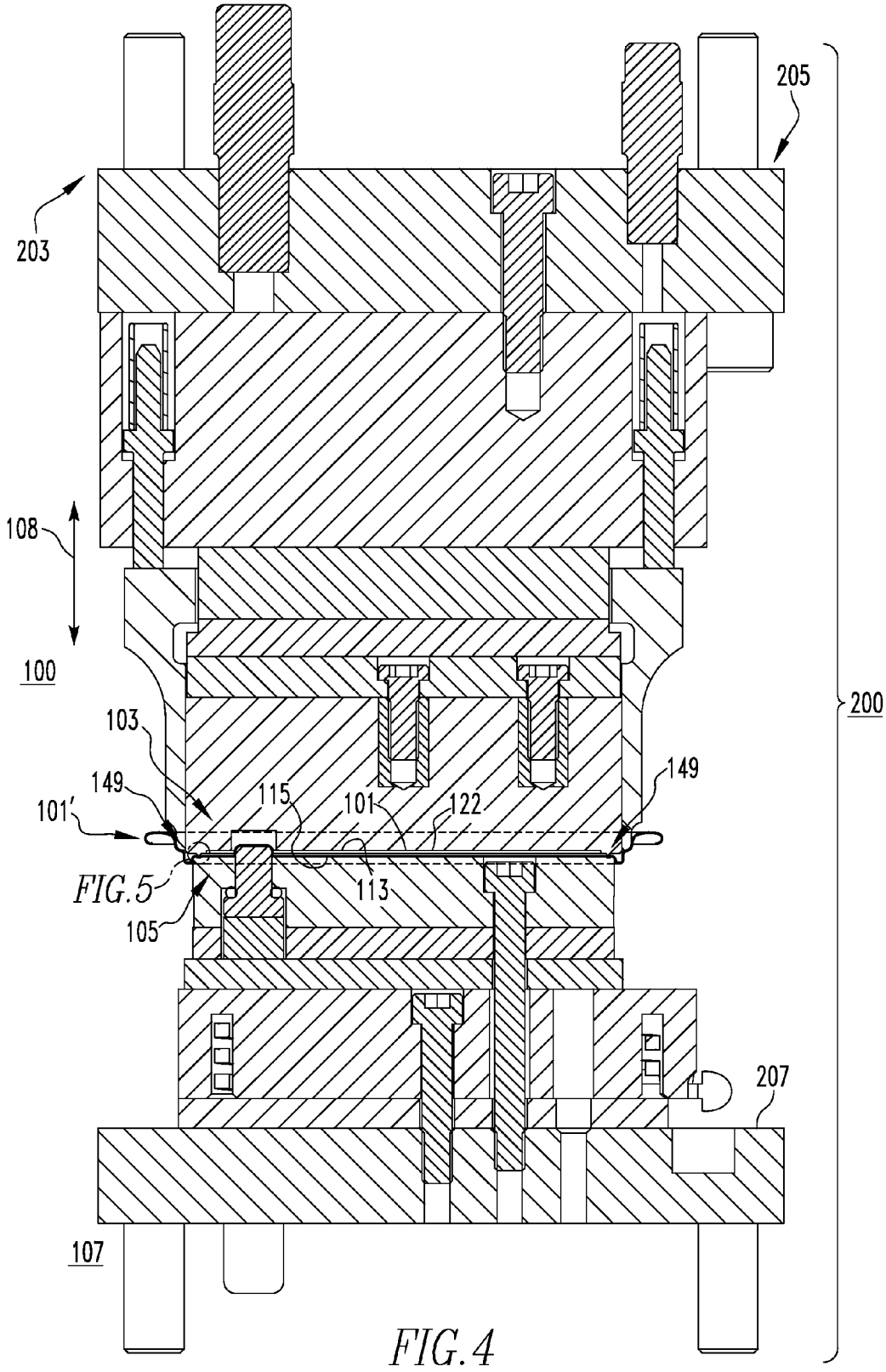
FIG. 4 is a sectional view of a tooling assembly for a tool station of a conversion press, in accordance with an embodiment of the invention, also showing a partially converted can end shell within the tool station.
Figure 5:
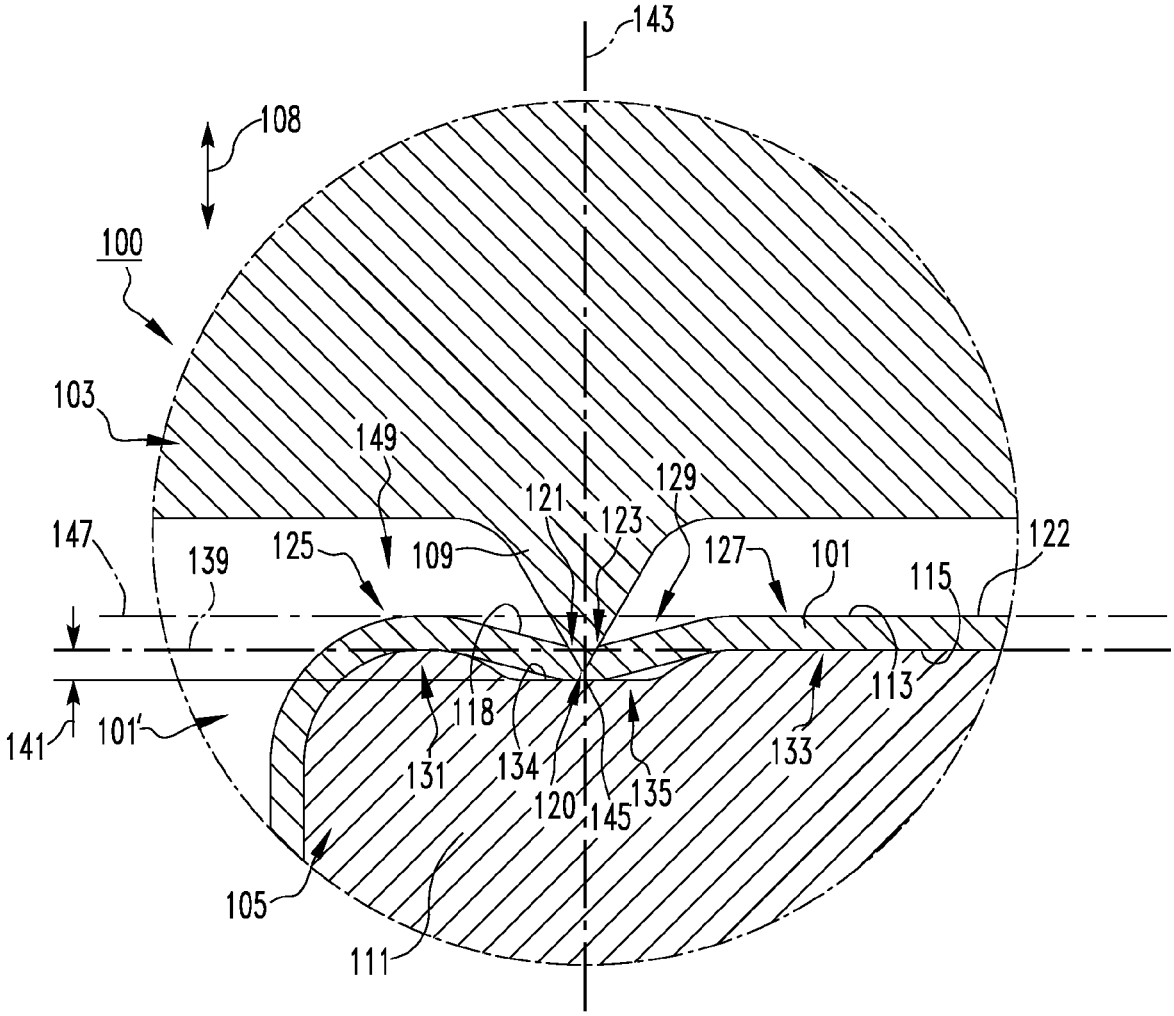
FIG. 5 is an enlarged view of a portion of the tooling assembly and partially converted can end shell of FIG. 4.

Having now described an illustrative example of the can end 101, which is formed in accordance with an embodiment of the invention, FIGS. 4 and 5 illustrate an example tooling assembly 100 for forming the can end 101 and, in particular, for converting a can end shell 101' into the desired can end 101 (FIG. 3). Specifically, in the container industry, a pre-converted can end 101 (FIG. 3) is commonly referred to as a can end shell, or simply a shell 101'. One such shell 101' is shown in FIGS. 4 and 5 undergoing a conversion operation to be converted into the desired can end 101, shown in FIG. 3. As defined herein, the terms "can end," "can end shell" and "shell" may be used interchangeably. Thus, it will be appreciated that the features of the pre-converted can end shell 101' of FIGS. 4 and 5, which are substantially the same as the resultant can end 101 of FIG. 3, are identified using the same reference numbers.

A conversion press 200, which is utilized to perform the conversion operations is partially shown in FIG. 4. The conversion press 200 includes a press ram (not expressly shown, but indicated generally by reference number 203 in FIG. 4), upper tooling 205 and lower tooling 207. A first tool member 103 and a second tool member 105 are respectively coupled to the upper tooling 205 and lower tooling 207 to form the desired tool station 107. In operation, the press ram 203 is actuated to advance the first tool member 103 toward the second tool member 105. It is foreseeable, however, that the second (e.g., bottom or lower from the perspective of FIG. 4) tool member 105 could be advanced towards the first tool member 103, or that both tool members 103,105 could be movable toward and away from one another, all within the scope of the invention.

Movement of the first (e.g., upper from the perspective of FIG. 4) tool member 103 of the example tool station 107 is indicated generally by arrow 108 of FIG. 4. In operation, the can end shell 101' is inserted between the opposing tool members 103,105 of the tooling assembly 100 and, upon actuation of the press ram 203, the upper and lower tooling members 103,105 cooperate to at least partially convert the can end shell 101' into the can end 101, shown in FIG. 3. After performing the desired operation, which will be further described hereinbelow with respect to FIG. 5, the press ram 203 retracts the upper tooling 205 and the upper tool member 103 coupled thereto, until the upper tool member 103 and lower tool member 105 are once again in the open, spaced apart position (not shown). The partially converted shell 101' can then be transported to the next successive tooling station (not shown) until the desired can end 101 (FIG. 3) is completely formed and discharged from the conversion press 200.

Accordingly, it will be appreciated that the conversion press 200 may have any known or suitable number and/or configuration of tool stations (e.g., 107) structured to perform any variety of desired operations such as, for example and without limitation, rivet forming, panel forming, scoring, embossing and/or final staking. The rivet forming operation, for example, and the corresponding tooling to effectuate the same, may utilize integral rivet development technology similar to that which is shown and described in U.S. Pat. Nos. 5,749,257; 5,755,134; and 5,851,685, which are hereby incorporated herein by reference. Additional non-limiting examples of tool stations (not shown), which could be employed to perform the foregoing operations are described, for example, in U.S. Pat. No. 7,270,246, which has been incorporated herein. It will also be appreciated that such tooling operations can be performed within a single conversion press (e.g., 200), wherein the upper and lower tooling 205,207 of the conversion press 200 is interchanged between conversion operations, or as separate portions or tool stations of the same press 200. Alternatively, any suitable number and/or configuration of separate presses (not shown) could be employed, one for each tool station.

As will now be described with reference to FIG. 5, one particularly unique aspect of the disclosed conversion press 200 (FIG. 4) and tooling assembly 100 therefor, is that the aforementioned scoreline 117 and depression 118 are formed substantially simultaneously using the same single tool station 107 (FIG. 4). Specifically, the first (e.g., upper from the perspective of FIG. 5) tooling member 103 includes a score knife 109 and the second (e.g., lower from the perspective of FIG. 5) tooling member 105 includes a score anvil 111. The score anvil 111 has a first support surface 131 for supporting the first portion 125 of the can end shell 101', a second support surface 133 for supporting the second portion 127 of the shell 101', and a cavity 135 disposed between the first and second support surfaces 131,133 beneath the third portion 129 of the shell 101'.

The score knife 109 is structured to depress the third portion 129 of the can end shell 101' into the cavity 135 of the score anvil 111, in order to form the depression 118 of the can end 101. More specifically, when the upper tool member 103 is advanced towards the lower tool member 105, as indicated by arrow 108 of FIG. 5, the score knife 109 engages the first side 113 of the can end shell 101' and depresses the can end shell 101' into the cavity 145 of the score anvil 111 until the second side 115 of the can end shell 101' engages the base 137 of the cavity 135. The score knife 109 then continues to advance towards the anvil 111 as it completes scoring of the first side 113 of the can end shell 101' to form the scoreline 117 therein. Accordingly, it will be appreciated that the depression 118 is formed, and the scoreline 117 is formed within the depression 118, substantially simultaneously in one operation in a single tool station 107 (FIG. 4), and upon a single actuation of the press ram 203 (FIG. 4). Among other benefits, not only does this simplify the shell conversion process, but it also decreases the wear and tear on the tooling (e.g., without limitation, tooling assembly 100 and components thereof).

More specifically, a conversion operation such as the one employed to form (e.g., bend the shell 101') the exemplary depression 118 would typically be performed in another, different tool station (not shown), which is separate from the scoring operation. However, in accordance with the invention, both operations are performed in the same tool station 107 (FIG. 4). Moreover, the exemplary tool station 107 in which both operations are performed, is disposed proximate to (e.g., without limitation, within about four inches or less) the center line (not shown) of the conversion press 200 (FIG. 4). At such a location, the bending moment on the tooling (e.g., without limitation, upper and lower tool members 103, 105) of the tooling assembly 100 is less than it would be, for example, if the conversion operation for forming the depression 118 were performed in another, different tooling station (not shown) that is disposed distal from (e.g., without limitation, as much as 16 inches or more) the center line (not shown) of the conversion press 200 (FIG. 4). In addition to reducing the wear and tear on the tooling, this also has the added benefit of insuring proper alignment between the tooling (e.g., without limitation, upper and lower tool members 103,105) and the can end shell 101', such that the scoreline 117 is positioned precisely as desired within the depression 118 of the can end shell 101'. Specifically, as shown in FIG. 5, the score knife 109 has a vertical axis 143, which is aligned with the center 145 of the base 137 of the score anvil cavity 135. In view of this precise alignment, the method of forming the score line 117 and depression 118 and the results thereof are consistent from one can end shell 101' to the next.

It will be appreciated that the particular shape of the score knife 109 is not intended to be a limiting aspect of the invention. For example and without limitation, a generally right-angled triangular score knife (not shown) could be employed. Such a score knife is disclosed, for example, in U.S. Pat. No. 5,462,396, which is hereby incorporated herein by reference. It will also be appreciated that the cavity 135 of the score anvil 111 could have any known or suitable alternative shape and/or configuration other than that which is shown and described, in order to provide the desired can end depression (e.g., 118). Specifically, although the first and second support surfaces 131,133 of the example score anvil 111 are disposed in a common plane 139, this need not necessarily be the case. Additionally, the score anvil cavity 135 has a depth 141 measured between the common plane 139 and the base 134 of the cavity. The particular shape and dimensions (e.g., without limitation, depth 141) of the cavity 135 are not meant to be limiting aspects of the invention. It is the precise alignment of the score knife 109 with the desired portion (e.g., center 145) of the score anvil cavity 135, as well as the fact that the scoreline 117 and depression 118 of the can end shell 101' are formed substantially simultaneously, which is advantageous. Specifically, these aspects of the invention decrease the likelihood of undesirable excessive strain on the product side 115 of the can end shell 101' during the formation of the depression 118 and the scoreline 117, which is disposed therein. Accordingly, an additional benefit of the disclosed tooling assembly 100 and associated method is that the potential for undesirable strain-induced metal exposure on the product side 115 of the can end shell 101' is substantially eliminated.

In view of the foregoing, it will be appreciated that the disclosed conversion press (FIG. 4), tooling assembly 100 (FIGS. 4 and 5) and associated method provide a superior can end 101 (FIG. 3), wherein the can end scoreline 117 is disposed within a depression 118 of the can end 101 such that it can be effectively and efficiently covered with a suitable sealant 119, as shown in FIG. 3. Additionally, by substantially simultaneously forming both the scoreline 117 and the depression 118 in which the scoreline 117 is disposed, all within a single tool station 107 (FIG. 4) of the conversion press 200 (FIG. 4), problems relating to alignment of the tooling and/or alignment between the scoreline 117 and depression 118 formed by the tooling are substantially avoided, and wear and tear on the tooling is minimized.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A tooling assembly for scoring a can end, said can end comprising a scoreline defining a severable panel, said tooling assembly comprising:

score knife; and score anvil disposed opposite said score knife, said score anvil being structured to cooperate with said score knife in order to form a depression in said can end and to form said scoreline within said depression, wherein the entire scoreline is disposed within said depression, wherein said can end further comprises a first portion, a second portion and a third portion; wherein said score anvil includes a first support surface structured to support the first portion of said can end, a second support surface structured to support the second portion of said can end, and a cavity disposed between said first support surface and said second support surface beneath the third portion of said can end; and wherein said score knife is structured to depress the third portion of said can end into said cavity of said score anvil in order to form said depression of said can end, wherein said can end further comprises a first side and a second side disposed opposite the first side; wherein said cavity of said score anvil has base; wherein said score knife is structured to engage the first side of said can end and to depress said can end into said cavity of said score anvil until the second side of said can end engages the base of said cavity; and wherein, when the second side of said can end engages the base of said cavity, the score knife is structured to score the first side of said can end, thereby forming said scoreline, and wherein said scoreline of said can end includes an apex, a first edge and a second edge; wherein the apex of said scoreline is disposed between the first side of said can end and the second side of said can end; wherein the first edge of said scoreline and the second edge of said scoreline are disposed at the first side of said can end; wherein the first side of the first portion of said can end and the first side of the second portion of said can end are disposed in a common plane; and wherein the first edge of said scoreline and the second edge of said scoreline are disposed within said depression of said can end and below the common plane of the first side of the first portion of said can end and the first side of the second portion of said can end.

2. The tooling assembly of claim 1 wherein said can end further comprises a periphery; wherein said depression comprises a channel extending around said can end proximate the periphery; and wherein said scoreline is a peripheral scoreline extending around said can end within said channel.

3. The tooling assembly of claim 1 wherein said score knife and said score anvil are coupled to a tool station of a conversion press; and wherein at least one of said score knife and said score anvil is structured to be advanced towards the other of said score knife and said score anvil.

4. The tooling assembly of claim 3 wherein said score knife of said tool station and said score anvil of said tool station are structured to substantially simultaneously form said depression in said can end and said scoreline within said depression.

5. The tooling assembly of claim 1 wherein said first support surface of said score anvil and said second support surface of said score anvil are disposed in a common plane; and wherein said cavity of said score anvil has a depth measured by the distance between the base of said cavity and the common plane of said first support surface of said score anvil and said second support surface of said score anvil.

6. The tooling assembly of claim 1 wherein said score knife has a vertical axis; wherein the base of said cavity of said score anvil has a center; and wherein the vertical axis of said score knife is aligned with the center of said base of said cavity.

7. A conversion press structured to convert a can end shell into a can end, said can end comprising a scoreline defining a severable panel, said conversion press comprising:

a press ram;

at least one tool station; and a tooling assembly coupled to a corresponding one of said at least one tool station, said tooling assembly comprising:

score knife, and score anvil disposed opposite said score knife, wherein said press ram is structured to advance at least one of said score knife and said score anvil toward the other of said score knife and said score anvil, and wherein, responsive to said press ram advancing said at least one of said score knife and said score anvil toward the other of said score knife and said score anvil, said score knife being structured to cooperate with said score anvil in order to create a depression in said can end and to form said scoreline within said depression, wherein the entire scoreline is disposed within said depression, wherein said can end further comprises a first portion, a second portion and a third portion; wherein said score anvil includes a first support surface structured to support the first portion of said can end, a second support surface structured to support the second portion of said can end, and a cavity disposed between said first support surface and said second support surface beneath the third portion of said can end; and wherein said score knife is structured to depress the third portion of said can end into said cavity of said score anvil in order to form said depression of said can end, wherein said can end further comprises a first side and a second side disposed opposite the first side; wherein said cavity of said score anvil has a base; wherein said score knife is structured to engage the first side of said can end and to depress said can end into said cavity of said score anvil until the second side of said can end engages the base of said cavity; and wherein, when the second side of said can end engages the base of said cavity, the score knife is structured to score the first side of said can end, thereby forming said scoreline, wherein said score knife has a vertical axis; wherein the base of said cavity of said score anvil has a center; and wherein the vertical axis of said score knife is aligned with the center of the base of said cavity.

8. The conversion press of claim 7 wherein said at least one tool station is a first tool station and at least a second tool station; wherein said score knife and said score anvil are coupled to said tooling assembly of said first tool station; and wherein said tooling assembly of said first tool station is structured to substantially simultaneously form said depression in said can end and to form said scoreline within said depression.

* * * * *

UNITED STATES PATENT AND TRADEMARK OFFICE
Certificate

Patent No. 8,122,747 B2 Patented: February 28, 2012

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Craig A. McEldowney, Russia, OH (US); Mark R. Mitchell, Sidney, OH (US); and Gregory H. Butcher, Columbus, OH (US).

Signed and Sealed this Twenty-eighth Day of January 2014.

SHELLEY SELF
*Supervisory Patent Examiner*
Art Unit 3725
Technology Center 3700